US006095776A

United States Patent [19]

Maki

[11] Patent Number: 6,095,776

[45] Date of Patent: Aug. 1, 2000

[54] PERISTALIC RUBBER IMPELLER PUMP

[75] Inventor: Bruce A. Maki, Hugo, Minn.

[73] Assignee: Hypro Corporation, St. Paul, Minn.

[21] Appl. No.: 08/925,457

[22] Filed: Sep. 8, 1997

[51] Int. Cl.[7] ..... F04C 2/00

[52] U.S. Cl. ..... 418/45

[58] Field of Search ..... 418/45, 153, 154, 418/156

[56] References Cited

U.S. PATENT DOCUMENTS 4,334,842 6/1982 Ikeda et al. ..... 418/45
4,456,442 6/1984 Gnagnetti ..... 418/153

OTHER PUBLICATIONS

Modern Plastics Encyclopedia '92, Mid–October Issue, Oct. 1991.

*Primary Examiner*—Timothy S. Thorpe
*Assistant Examiner*—Liem Nguyen
*Attorney, Agent, or Firm*—Nikolai, Mersereau & Dietz, P.A.

[57] ABSTRACT

A fluid handling pump for precise metering applications includes a flexible impeller mounted on a shaft that is eccentric to the centerline of a cylindrical chamber of the pump's housing. The impeller includes a plurality of flexible walls, that cooperate with an integrally molded hub and a rim like spokes, to define a plurality of compressible chambers. During rotation of the impeller, the volume of the compressible impeller chambers varies from a maximum in passing the pump's suction port to a minimum when sweeping past the pump's discharge port. In this way, a peristaltic pumping action takes place.

9 Claims, 4 Drawing Sheets

PERISTALIC RUBBER IMPELLER PUMP

BACKGROUND OF THE INVENTION

I. Field of the Invention

This invention relates generally to fluid handling pumps, and more particularly to an improved design of a rotary peristaltic pump especially adapted for metering measured quantities of various fluids, especially abrasive fluids or viscous fluids.

II. Discussion of the Prior Art

A variety of pump types have been used in the past for pumping liquids which are abrasive, viscous or that must be pumped in precisely metered quantities. Typically, piston pumps and gear pumps are unsuitable in such applications. When dealing with abrasive fluids, piston pumps and gear pumps are subject to rapid wear and failure. Progressive cavity pumps, diaphragm pumps, hose-type peristaltic pumps and open bladed rubber impeller pumps, while suitable for pumping abrasive liquids suffer from other drawbacks relating to size, cost, viscosity, mounting, chemical compatibility and wear do not make these pumps suitable for all types of metering applications.

For example, progressive cavity pumps incorporating a helical screw have been used for many years to handle abrasive and viscous fluids. While they exhibit minimal pulsation in the flow of liquid being delivered, they tend to be costly, overly long for certain applications and generally require a double universal joint on a connecting rod located in the fluid being pumped to follow eccentric motion of the screw rotor. Also, vibration of the pump due to eccentric motion of the rotor must be addressed. The progressive cavity pumps have found application primarily in aggressive industrial fluid delivery systems where space, cost and mounting requirements are not restrictive.

Diaphragm pumps are also commonly used for delivering abrasive and viscous liquids. While relatively cost effective and small in size, they do require valves which are subject to failure and require frequent replacement. Further, the fluid flow necessarily pulsates as the diaphragms are reciprocally displaced. Because of the pulsatile flow, diaphragm pumps are most often used for liquid transfer rather than metered flow.

Peristaltic pumps are most commonly of the tube (hose) variety where the tube is periodically squeezed of fluid by means of rollers that are made to rotate about a central shaft. Peristaltic pumps offer the advantage of simplicity and ease of maintenance, as it is only necessary to change a hose or tube while retaining the motor-driven roller assembly used to squeeze the fluid in the hose and thereby advance it towards a pump outlet. Such pumps are void of valves and are capable of pumping a wide variety of fluids.

The drawback of conventional peristaltic pumps is that the tube must recover its cylindrical shape following the passage of each roller there over and the time required for the tube's elasticity to restore it to its normal shape necessarily limits the operating speed of such a pump. Also, such pumps inherently create a pulsatile flow.

Conventional prior art rubber impeller pumps have been noted for their ability to pump fluid with no pulsation and also to handle abrasive fluids. However, they do suffer the disadvantage of low pressure operation and high amounts of internal slip, particularly under relatively modest output pressures. Further, the open blade impeller material must have mechanical properties which allows the blade to follow the profile of the housing. This restricts the material selection almost exclusively to elastomer such as neoprene, Buna-N and EPDM. Thus, they are typically used in low pressure fluid transfer and circulation. Typically, rubber impeller pumps are used in household washing machines to empty water from its drum into a drain or as a water pump used in the cooling systems for internal combustion engines.

In certain metering applications, such as delivery of precise quantities of colorants to a white tint base in preparing different shades and tints of paint used in decorating or the like, a microprocessor-based controller is typically used to drive a stepper or servo motor that, in turn, drives a metering pump for depositing a selected volume of a selected colorant into the white tint base. For the reasons advanced above, prior art pumps of the type described are less than adequate in this application. First of all, it is recognized that paint colorants are generally highly abrasive and would rather quickly wear out a piston or gear-type metering pump. It is difficult to obtain the desired precision from pumps exhibiting pulsatile flow. The internal slip of traditional rubber impeller pumps also results in variation in the quantity of material delivered per revolution or fraction thereof and make that type of pump unsuitable for precision applications.

Thus, a need exists for a pump capable of handling abrasive and viscous fluids, that does not require valves and that is capable of pulsation-free operation. It is the object of the present invention to provide just such an arrangement.

SUMMARY OF THE INVENTION

In accordance with the present invention, the best properties of a rubber impeller pump are combined with those of a peristaltic pump. A fluid handling pump in accordance with the present invention comprises a pump body defining a cylindrical chamber having an inlet or suction port and an outlet or discharge port in fluid communication with the cylindrical chamber. The pump's impeller assembly includes a cylindrical shaft with an inner rigid ring member affixed to the shaft and an outer rigid ring member dimensioned to fit within the cylindrical chamber of the pump body for rotation therein. An impeller formed from a suitably flexible material has a plurality of regularly spaced, arcuately-shaped, flexible walls that extend between the rigid inner ring member toward the rigid outer ring member to define a plurality of compressible chambers. The impeller assembly is disposed within the cylindrical chamber of the pump body with its cylindrical shaft eccentrically disposed with respect to a longitudinal axis of the cylindrical chamber, such that rotation of the shaft reduces the volume of the plurality of compressible chambers in moving from a location in the pump body aligned with the inlet port toward a location in the pump body aligned with the outlet port.

The impeller assembly used in the present invention differs from the rubber impeller used in prior art impeller pumps in that rather than having radiating blades whose blade tips sweep against the walls of the pump body, a plurality of discrete compressible chambers are created in the impeller, as by molding, cutting, stamping etc. Fluid to be pumped flowing through the inlet port flows into an impeller chamber when it is at its maximum volume and that chamber becomes squeezed down to a smaller volume due to the fact that the impeller assembly is eccentric relative to the center line of the pump housing. Upon reaching the pump's discharge port, the fluid being pumped is under increased pressure and dispensed through the discharged port.

DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DESCRIPTION OF THE PREFERRED EMBODIMENT

Figure 1:
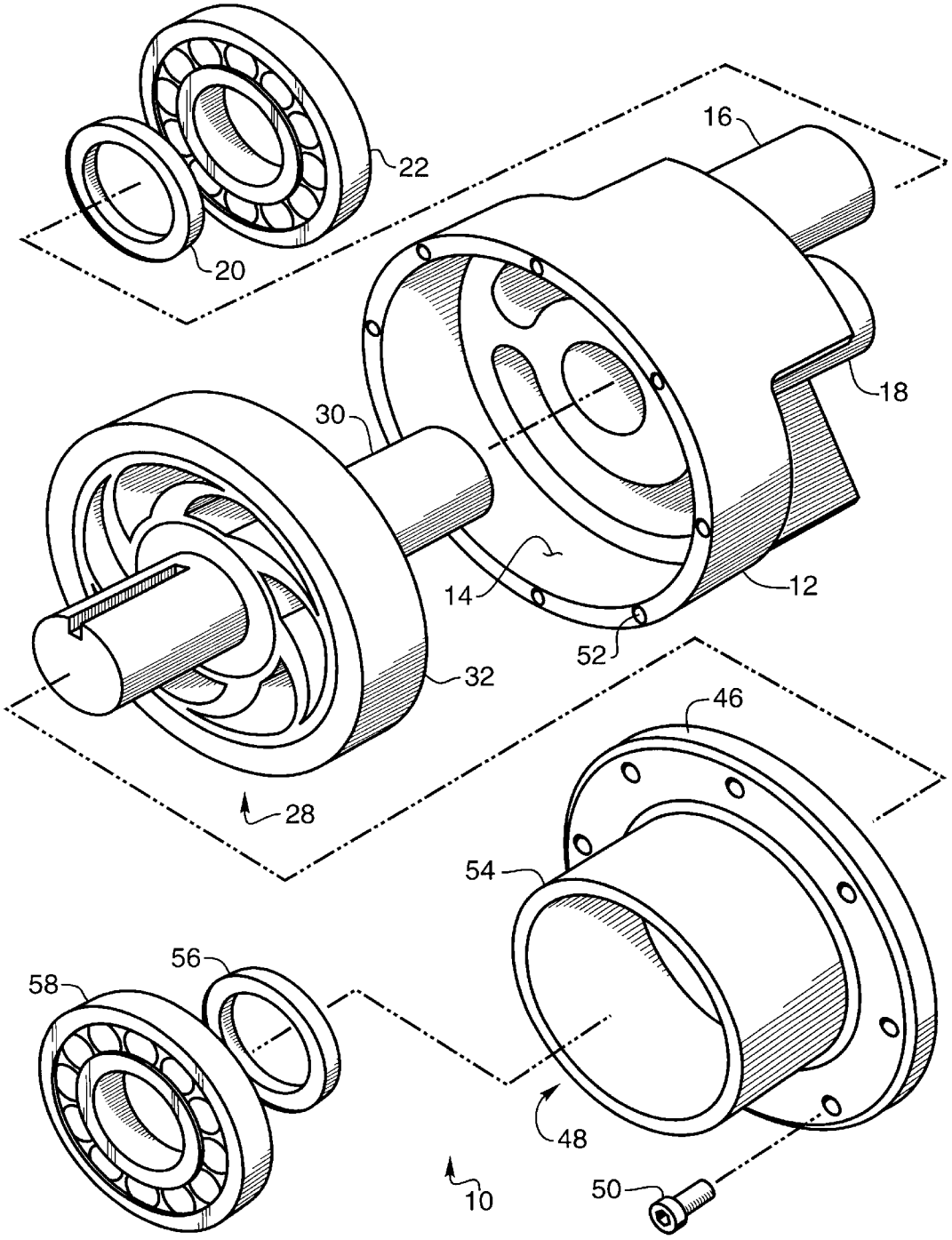
FIG. 1 is an exploded perspective view of a peristaltic flexible impeller pump constructed in accordance with the present invention.

Referring to FIG. 1, the flexible impeller peristaltic pump is indicated generally by numeral 10 and is seen to comprise a pump body or housing 12 that is preferably cast from a suitable metal to define a cylindrical chamber 14 therein. Formed axially in the end of the pump body 12 is a suction or inlet connection 16 and an outlet or discharge connection 18. The end of the pump body 12 also includes a cylindrical, shaft-receiving bore that is surrounded by an annular collar, neither of which is visible in the view of FIG. 1. The annular collar comprises a bearing housing and is designed to contain a shaft seal member 20 and a shaft bearing 22.

Figure 3:
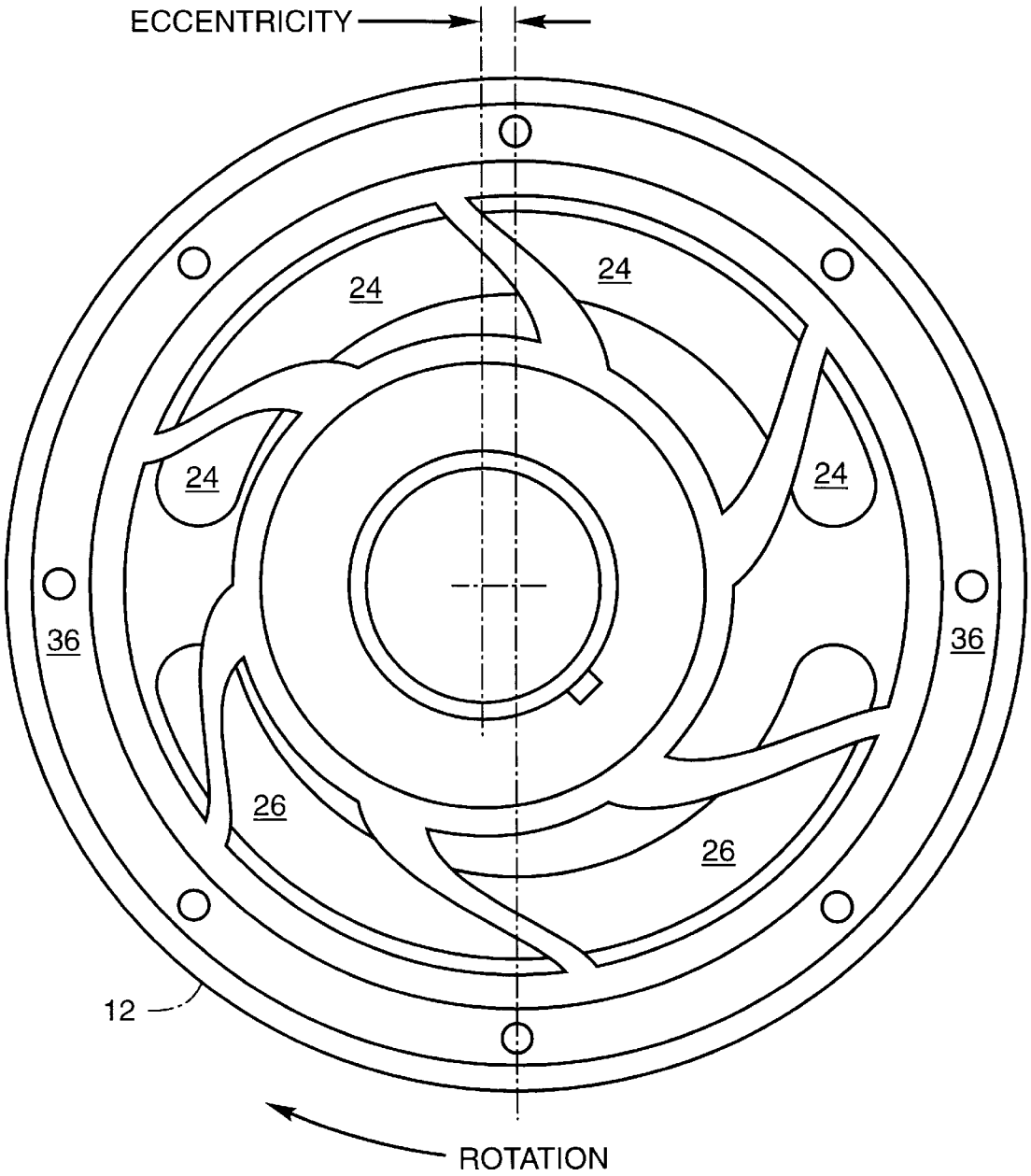
FIG. 3 is a view showing the relationship between the impeller assembly and the suction and discharge ports formed in the pump body.

Referring momentarily to FIG. 3, the suction connection 16 leads to and is in fluid communication with an arcuate groove 24 that extends circumferentially through an angle slightly less than 180°. Likewise, the discharge connection 18 is in fluid communication with a further groove 26 formed in the end of the pump body 12 and it, too, extends circumferentially through an angle that is slightly less than 180°. The two grooves are isolated from one another; i.e., they do not overlap one another.

Figure 2:
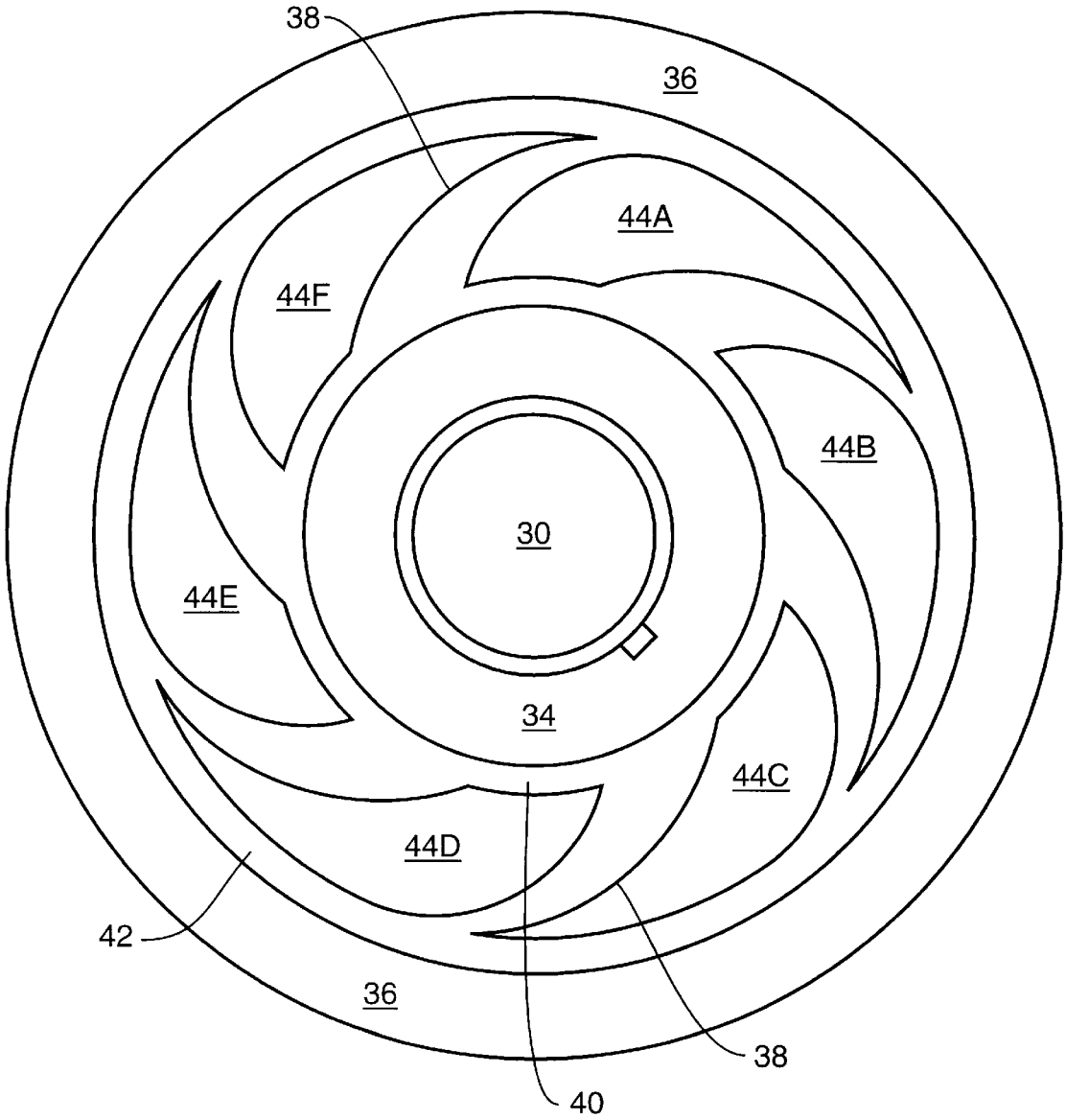
FIG. 2 is an end view of the impeller assembly used in the pump of FIG. 1.

Referring back to FIG. 1, the impeller assembly for the pump is indicated generally by numeral 28. It includes a cylindrical pump shaft 30 and keyed to the shaft and rotatable therewith is an impeller 32, the constructional details of which are best seen in the enlarged end view of FIG. 2. Surrounding the shaft 30 is the inner rigid ring 34 having an inner circular radius allowing it to fit about the shaft 30 in surrounding relation. The impeller 32 further includes an outer rigid ring 36 that is maintained generally concentric with the inner ring 34 by flexible, arcuate, elastomeric web-like spokes as at 38. The concentric relationship between the rigid inner ring 34 and the rigid outer ring 36 can be readily altered due to the flexibility of the ribs 38.

In fabricating the flexible portion of the impeller, it is preferably molded or fabricated as a single piece from a suitable material exhibiting good flex, fatigue and mechanical properties, such as elastomers (Neoprene®, Nitrile, fluoroelastomer, etc.), plastic such as Teflon®, Nylon®, etc., compound plastic/elastomer such as Santoprene®, or fabrics such as Kevlar®. When molding from the common elastomer compounds, such as Neoprene, it may typically have a Shore A hardness in the range of from about 55 to 85.

It is formed so as to include an inner tubular hub portion 40 and an outer rim portion 42 connected together by the arcuate webs 38. The webs 38 are seen to taper in thickness from a larger dimension proximate the hub 40 to a significantly lesser dimension proximate the rim 42. The webs 38 have an axial dimension corresponding to the width of the impeller assembly shown in FIG. 1 and thereby define a plurality of hollow chambers labeled 44*a* through 44*f*.

The rigid annular insert 34 fits within the central opening of the inner tubular hub portion 40 and the two are bonded together.

Figure 4:
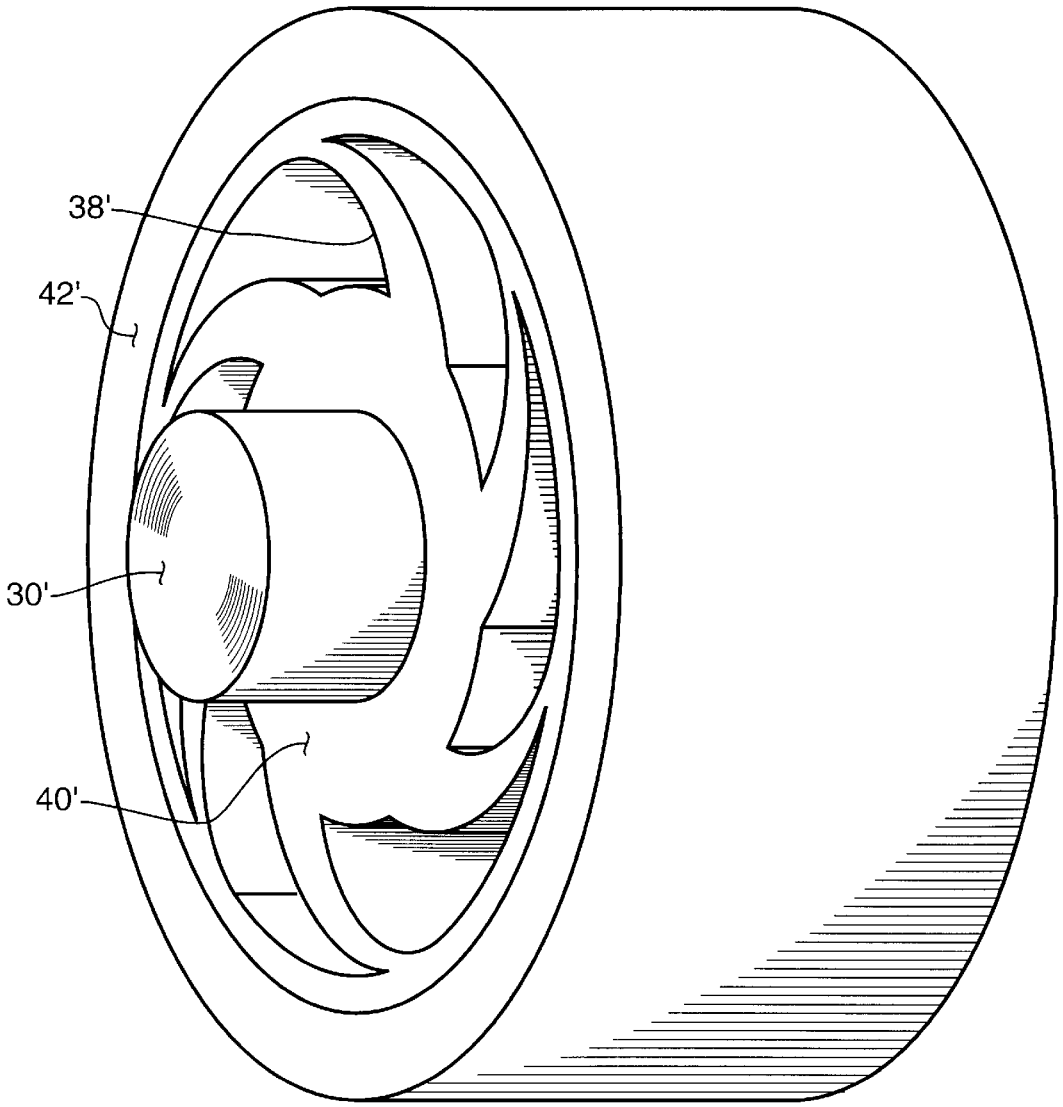
FIG. 4 is a perspective view of an alternative impeller construction.

An alternative impeller construction is illustrated in FIG. 4. Here, the rigid outer ring 36 is eliminated and, instead, the rim 42' is made sufficiently thick in comparison to the flexible chamber walls 38' that there is little flexing occurring in the outer rim 42'. The means of attaching the inner portion 40' of the impeller may also be accomplished by molding, bonding or mechanically driving the material of the impeller directly to the shaft 30' so as to eliminate the need for an inner insert as at 34 in the embodiment illustrated in FIG. 2.

In assembling the pump 10, the rightmost end of the shaft 30, as shown in FIG. 1, is inserted through the circular bore formed in the end wall of the pump body 12 that is slightly offset from the centerline of the cylindrical chamber 14, thereby providing a degree of eccentricity between the impeller assembly 28 and the pump body 12. The leftmost end portion of the shaft 30 fits through a circular bore (not shown) formed through the thickness dimension of the flange portion 46 of a bearing housing 48. The flange 46 is adapted to be secured to the open end of the pump body 12.

The bearing housing 48 includes an annular collar 54 for containing a shaft seal member 56 and a shaft bearing 58.

Returning again to FIG. 3, because of the eccentricity between the chamber 14 in the pump body and the axis of rotation of the impeller assembly, as the impeller assembly is rotated in the direction indicated by the arrow, the capacity or volume of the chambers 44*a* through 44*f* are at a maximum while sweeping past the groove 24 comprising the suction port and are squeezed down to a minimum while sweeping past the arcuate groove 26 comprising the discharge port. This, of course, is due to the fact that as the impeller rotates, the outer ring 36 or the rim 42' of the impeller assembly rides against the inner wall of the pump body 12 defining the cylindrical chamber 14 while the inner ring 34 or hub 40' is driven by the shaft 30. The eccentricity of the shaft to the housing distorts the compressible chambers 44, thereby creating a rotary peristaltic effect.

Fluid enters the impeller from an axial direction to fill the impeller chamber as the volume increases to a maximum while it sweeps by the half revolution defined by the suction port groove 24. Likewise, as the volume of the chamber decreases during the second half of rotation, the chamber is discharging its pressurized contents through the circumferential groove 26 defining the discharge port.

The pump configured as described provides smooth, substantially pulsation free flow and does not require valves of any type. By proper attention to dimensional tolerances, the use of the chambered, flexible impeller 32 creates a leak-free peristaltic pumping action suitable for precision metering applications.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself. For example, we do not wish to limit the material comprising the flexible peristaltic chamber impeller to elastomers, but instead, to any material with suitable flex properties to allow compression of the peristaltic chambers. Examples of such materials include but are not limited to such elastomers, flexible plastics or even an assembly which uses a fabric covered with a liquid impervious sealant.

What is claimed is:

1. A fluid handling pump comprising:

(a) a pump body defining a cylindrical chamber with a suction port and a discharge port in fluid communication with the cylindrical chamber;

(b) an impeller assembly including a cylindrical shaft, an inner rigid hub member affixed to the shaft, an outer, relatively rigid rim member dimensioned to fit within the cylindrical chamber of the pump body for rotation therein, and a plurality of regularly, angularly-shaped, flexible walls extending spirally between the inner rigid hub member toward the outer rim member and defining a plurality of compressible chambers; and (c) means for mounting the cylindrical shaft eccentrically with respect to a longitudinal axis of the cylindrical chamber such that rotation of the shaft reduces the volume of the plurality of compressible chambers in moving from a location in the pump body of the suction port toward a location in the pump body of the discharge port.

2. The fluid handling pump as in claim 1 wherein said inlet port and said outlet port are formed in an axial direction through an end wall of the pump body.

3. The fluid handling pump as in claim 2 wherein said suction port and said discharge port are each arcuate and span an angle that is less than 180°.

4. The fluid handling pump as in claim 1, the hub, rim and flexible walls defining the plurality of compressible chambers are formed of a material exhibiting the ability to be flexed repeatedly without fatigue failure.

5. The fluid handling pump as in claim 4 wherein the material is selected from a group consisting of elastomeric polymers, plastic polymers, blends of said elastomeric and plastic polymers and sealant covered fabrics.

6. The fluid handling pump as in claim 1 wherein the hub member includes a rigid ring insert surrounding the shaft.

7. The fluid handling pump as in claim 1 and further including a rigid ring surrounding said rim member.

8. The fluid handling pump as in claim 1 and further including a cover plate attachable to the pump body, the cover plate including a bore for receiving the cylindrical shaft therethrough and an annular collar concentric with the bore in the cover plate; and bearing means for supporting the cylindrical shaft within the annular collar.

9. The fluid handling pump as in claim 8 and further including a shaft seal disposed in the annular collar and surrounding the cylindrical shaft.

* * * * *